US008292368B1

(12) United States Patent
Yarbrough

(10) Patent No.: US 8,292,368 B1
(45) Date of Patent: Oct. 23, 2012

(54) BATTERY-POWERED ADJUSTABLE BOAT SEAT

(76) Inventor: William S. Yarbrough, Montgomery, AL (US)

( * ) Notice: Subject to any disclaimer, the term of this patent is extended or adjusted under 35 U.S.C. 154(b) by 219 days.

(21) Appl. No.: 12/651,615

(22) Filed: Jan. 4, 2010

(51) Int. Cl.
*A47C 1/00* (2006.01)

(52) U.S. Cl. ..... 297/344.12; 297/326; 297/344.15; 297/344.16; 297/344.17; 297/353

(58) Field of Classification Search ..... 297/344.1, 297/344.12, 344.15–344.17, 353, 340, 236–328; 114/363
See application file for complete search history.

(56) References Cited

U.S. PATENT DOCUMENTS

| | | | | |
|---|---|---|---|---|
| 3,851,916 | A * | 12/1974 | Quartullo | 297/188.21 |
| 4,234,989 | A | 11/1980 | Pearcy | |
| 4,453,766 | A | 6/1984 | DiVito | |
| 4,461,444 | A * | 7/1984 | Grassl et al. | 248/550 |
| 4,673,155 | A | 6/1987 | Binder | |
| 4,700,921 | A * | 10/1987 | Holbrook | 248/421 |
| 4,709,649 | A | 12/1987 | Wann | |
| 4,790,716 | A * | 12/1988 | McConnell | 414/678 |
| 5,169,113 | A * | 12/1992 | Brodersen | 248/550 |
| 5,215,351 | A | 6/1993 | Lapointe | |
| 5,297,849 | A * | 3/1994 | Chancellor | 297/344.12 |
| 5,636,900 | A | 6/1997 | Wilkie et al. | |
| 5,927,679 | A * | 7/1999 | Hill | 248/588 |
| 6,065,422 | A * | 5/2000 | Davidson et al. | 114/363 |
| 6,431,109 | B1 * | 8/2002 | Martin | 114/363 |
| 7,185,867 | B2 * | 3/2007 | Hill et al. | 248/421 |
| 7,677,663 | B1 * | 3/2010 | Charles et al. | 297/256.12 |
| 2003/0011229 | A1 * | 1/2003 | Bell | 297/344.17 |
| 2007/0216209 | A1 | 9/2007 | Kuenzel et al. | |
| 2008/0251001 | A1 * | 10/2008 | Draghici et al. | 114/363 |
| 2010/0066146 | A1 * | 3/2010 | Weber et al. | 297/340 |
| 2010/0072797 | A1 * | 3/2010 | Telesco | 297/216.19 |
| 2010/0072800 | A1 * | 3/2010 | Weber et al. | 297/344.15 |
| 2010/0117428 | A1 * | 5/2010 | Deml et al. | 297/344.15 |

FOREIGN PATENT DOCUMENTS

| | | | |
|---|---|---|---|
| GB | 2129678 | A * | 5/1984 |
| JP | 63263191 | A * | 10/1988 |

* cited by examiner

*Primary Examiner* — Laurie Cranmer
(74) *Attorney, Agent, or Firm* — Montgomery Patent & Design, LLC; Robert C. Montgomery; Joseph Yaksich

(57) ABSTRACT

An electrically-operated seating apparatus for use on a boat which assists a user in standing up or sitting down is intended for use by elderly and/or disabled users, particularly in low-riding boats such as bass-boats, ski-boats and the like. The apparatus comprises a chair assembly mounted to the boat deck and a drive assembly which raises the seat up and down and tilts seat portion forward with the aid of electrical drive motors. In such a manner, the user can be assisted when getting into or out of the chair. Each side of the seat portion is provided with a small armrest to help secure the individual as well as aid in the lifting and lowering process. The electric motors would be powered from the boat battery and controlled through a set of arm-mounted switches.

14 Claims, 4 Drawing Sheets

BATTERY-POWERED ADJUSTABLE BOAT SEAT

RELATED APPLICATIONS

The present invention was first described in a notarized Official Record of Invention filed on Feb. 20, 2009 at the offices of Montgomery Patent and Design. There are no previously filed, nor currently any co-pending applications, anywhere in the world.

FIELD OF THE INVENTION

The present invention relates generally to fishing boats, and in particular, to an adjustable boat seat particularly designed for ease of access and adjustment.

BACKGROUND OF THE INVENTION

Fishing is a popular pastime around the world. Large, motorized boats represent a significant aspect of this hobby. In particular, significant fishing investments such as large boats are statistically most often undertaken by individuals later in life who are disposed with greater amounts of disposable income and free time.

Statistically, these individuals most predisposed to spending large amounts of time on boats for activities such as fishing are also those most prone to physical disabilities and ailments which make such endeavors more difficult. In particular, many such individuals may have difficulty with the constant standing and sitting associated with fishing. The act of standing, sitting, or readjusting position once situated in a fishing seat on a boat can cause great distress, especially when undertaken repeatedly.

Various attempts have been made to provide automatic or adjustable seats or chairs for boats. Examples of these attempts can be seen by reference to several U.S. patents. U.S. Pat. No. 4,234,989, issued in the name of Pearcy, describes an adjustable pedestal for a boat seat. The Pearcy apparatus comprises a telescoping base which allows a user to adjust the height of their seat in a vertical manner.

U.S. Pat. No. 4,673,155, issued in the name of Binder, describes a method for providing vertically adjustable boat furniture. The Binder apparatus uses a system of pistons to raise and lower a seating surface on a boat.

U.S. Pat. No. 4,709,649, issued in the name of Wann, describes a bass boat adjustable seat apparatus. The Wann apparatus allows a user to rotate their seat about a central axis.

While these devices fulfill their respective, particular objectives, each of these references suffer from one (1) or more of the aforementioned disadvantages. Many such apparatuses do not provide for both horizontal and vertical adjustability as well as rotational motion. Also, many such apparatuses do not allow a user to tilt the seat forward in order to help those with physical disadvantages easy access to and from the seat. In addition, many such apparatuses are not suitably adapted for use on a boating surface. Furthermore, many such apparatuses are not adjustable in a manner which is automatic or physically undemanding for those with physical disadvantages. Accordingly, there exists a need for an adjustable boat seat without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a boat seat which provides a full range of adjustability and accessibility to those with physical disadvantages in a manner which is simple and physically undemanding. Thus, the object of the present invention is to solve the aforementioned disadvantages and provide for this need.

To achieve the above objectives, it is an object of the present invention to comprise a chair, an adjusting mechanism, a chair mount, a pedestal, and a foot. The adjusting mechanism is connected to the chair in a manner that adjustably positions the chair between forwardly tilted and normally upright positions. The foot is connected to the pedestal and is fastenable to a boat deck.

Another object of the present invention is to comprise the adjusting mechanism of a control pad, lower and upper platforms, and first and second pairs of crossed links. The control pad is connected to the chair and comprises a plurality of motion control switches. The first and second pairs of crossed links connect corresponding first and second side portions of the lower and upper platforms.

Yet still another object of the present invention is to affix the lower platform to the chair mount and the upper platform to the chair and lower platform. The first and second pairs of crossed links comprise "X"-shaped supports which connect side portions of the upper and lower platforms. The seat further comprises first and second axles which perpendicularly connect corresponding lower ends of the first and second pairs of crossed links.

Yet still another object of the present invention is to further comprise the adjusting mechanism of electrically powered rotatable first and second jacks. The first jack transfers forward and rearward motion onto the second axle to cause a scissor-like lifting action to the upper platform and chair. The second jack raises and lowers a rear portion of the upper platform when subjected to an upward or downward motion, respectively.

Yet still another object of the present invention is to further comprise the adjusting mechanism of first and second guides located on first and second sides of the rear portion of the upper platform. The guides engage with the first axle to guide the seat into place.

Yet still another object of the present invention is to provide a method of utilizing the device that provides a unique means of allowing a user to adjustably position the chair between forward tilted and normally upright positions in an automatic manner, thus providing easy access and adjustability in particular for persons with physical disadvantages.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | adjustable seat |
| 11 | chair |
| 12 | first arm |
| 13 | second arm |
| 14 | pedestal |
| 15 | foot |
| 16 | chair mount |
| 20 | adjusting mechanism |
| 21 | lower platform |
| 22 | upper platform |
| 23a | first link |
| 23b | third link |
| 24a | second link |
| 24b | fourth link |
| 25 | first axle |
| 26 | second axle |
| 27 | first nut |
| 28 | first jack |
| 29a | first slot |
| 29b | second slot |
| 31 | second jack |
| 32 | second nut |
| 33 | first screw |
| 34 | second screw |
| 37a | third slot |
| 37b | fourth slot |
| 38a | first guide |
| 38b | second guide |
| 39 | jack window |
| 41 | control pad |
| 42 | first switch |
| 43 | second switch |
| 44 | first cord |
| 45 | receptacle |
| 46 | second cord |
| 47 | power cord |
| 48 | access aperture |
| 49 | male plug |
| 60 | deck |

DETAILED DESCRIPTION OF THE PREFERRED EMBODIMENT

The best mode for carrying out the invention is presented in terms of its preferred embodiment, herein depicted within FIGS. 1 through 3C. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a battery powered adjustable boat seat apparatus (herein described as the "apparatus") 10, which provides a means to assist a user in standing up or sitting down in a boat.

Figure 1:
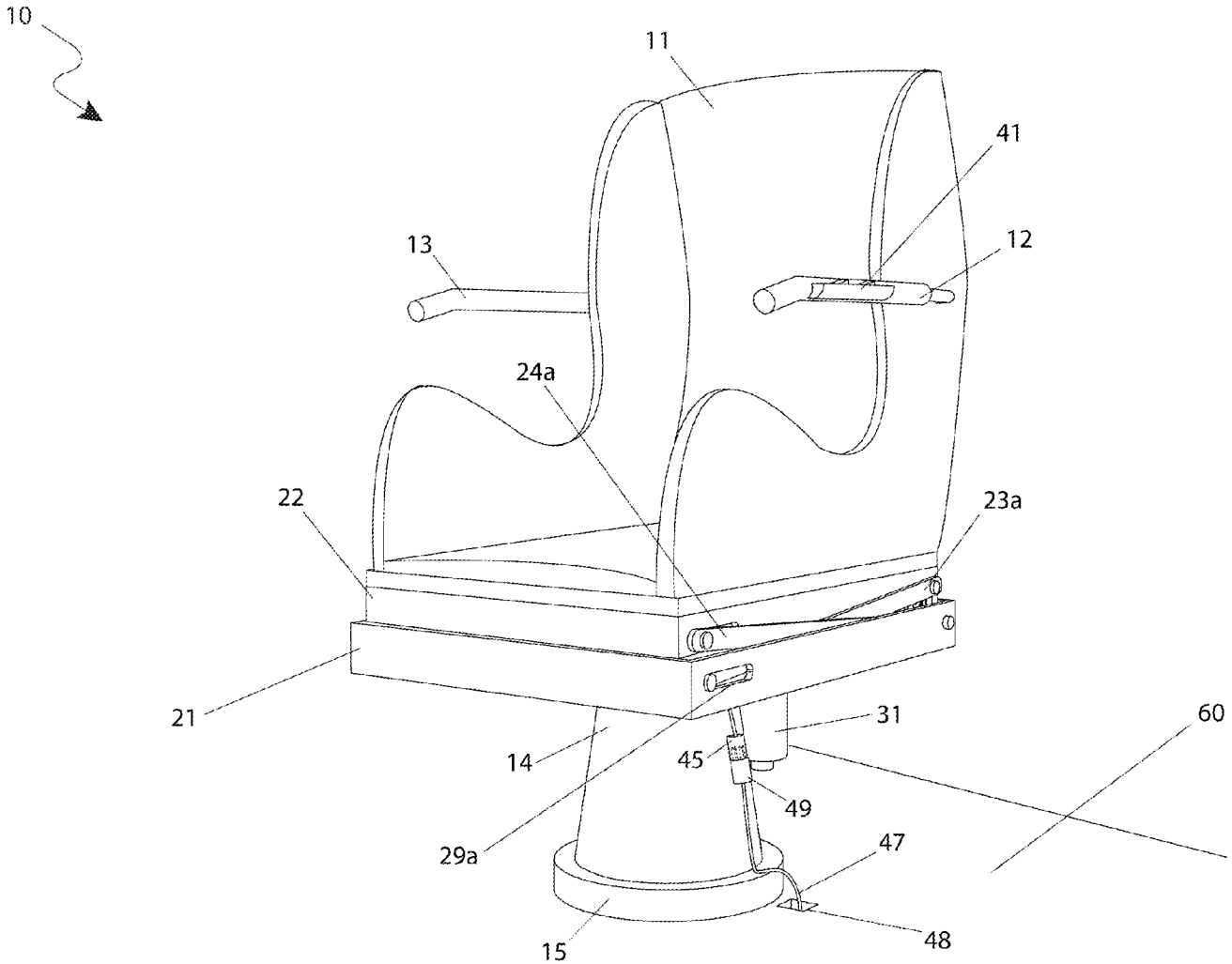
FIG. 1 is a perspective front view of an adjustable seat 10, according to a preferred embodiment of the present invention.

Referring now to FIG. 1, a perspective front view of the apparatus 10, according to the preferred embodiment of the present invention, is disclosed. The apparatus 10, depicted as mounted thereupon a boat deck 60, comprises a chair 11, a first arm 12, a second arm 13, a pedestal 14, a foot 15 and a chair mount 16. The first arm 12 comprises a control pad 41 comprising a pair of motion control switches 42 and 43. The pair of arms 12 and 13 is designed to comfortably retain a user while seated thereupon the chair 11. The assembly of the pedestal 14 and the foot 15 provides the means for permanently fastening the apparatus 10 thereupon an upper portion of the deck 60 and for securely supporting the assembly of the chair 11 and the adjusting mechanism 20. The chair mount 16 provides a means for securely fastening the lower platform 21 thereonto the pedestal 14. Depending on the intended usage of the boat, the assembly of pedestal 14 and the foot 15 can be designed to be a fixed or rotational configuration, either of which is secured thereupon the deck 60 by means of bolts, screws, or toe clamps.

Figure 2B:
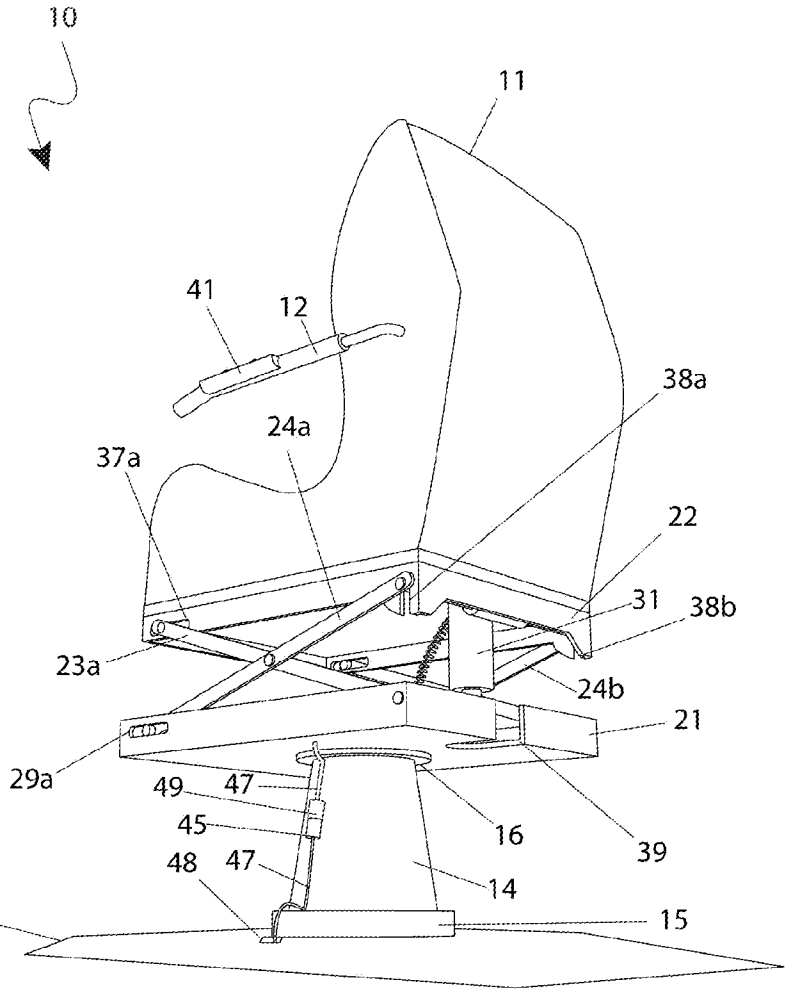
FIG. 2B is a perspective rear view of the adjustable seat 10 in a raised state, according to the preferred embodiment of the present invention.
Figure 2A:
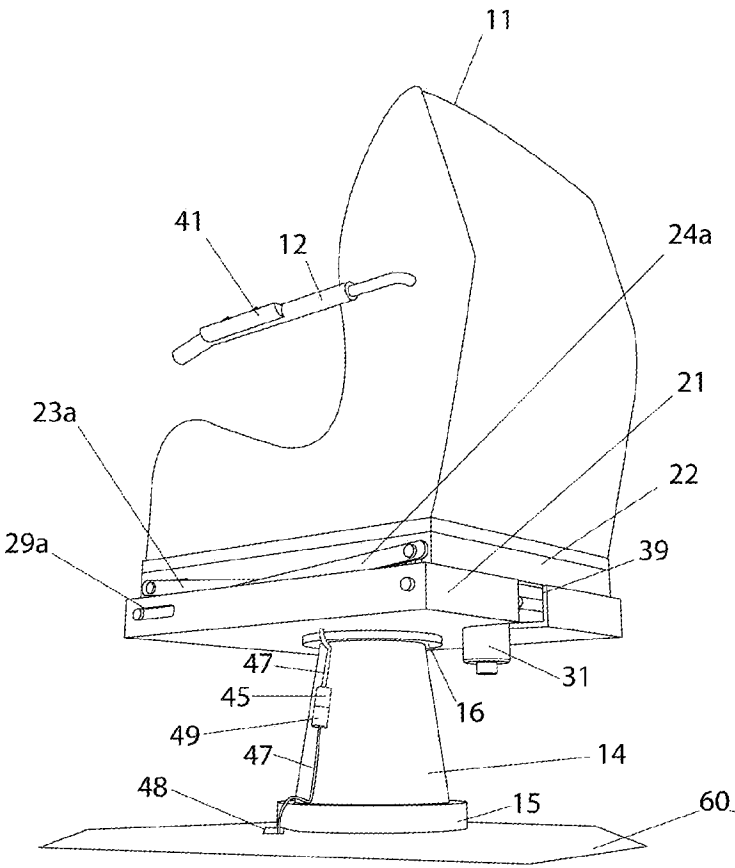
FIG. 2A is a perspective rear view of the adjustable seat 10 in a lowered state, according to the preferred embodiment of the present invention.

Referring now to FIG. 2A, a perspective rear view of the apparatus 10, according to the preferred embodiment of the present invention, is disclosed. The apparatus 10, shown in a lowered and upright position, comprises a lower platform 21 and an upper platform 22. The lower platform 21 is shown affixed thereto the chair mount 16 portion of the pedestal 14. A first pair of crossed links 23*a* and 24*b* connects a first side portion of the lower platform 21 to a corresponding side portion of the upper platform 22, and a second pair of crossed links 23*b* and 24*b* connects a second side portion of the lower platform 21 to a corresponding side portion of the upper platform 22. The interior portion of the chair 11 is envisioned to comprise a supporting frame made of materials such as, but not limited to: steel, aluminum, or plastics, in shapes such as, but not limited to: tubing, extrusions or stampings. This frame is securely fastened thereonto the upper platform 22 and envisioned to comprise an appropriate plurality of cushioning springs covered with any of a variety of moisture resistant padding materials. The exterior portion of the chair 11 is envisioned to comprise a water resistant covering made of materials such as, but not limited to: vinyl, artificial leather, rubber, or any suitable fabric or plastic materials, all envisioned to be decorated in attractive colors and themes.

Referring now to FIG. 2B, a perspective rear view of the apparatus 10, according to the preferred embodiment of the present invention, is disclosed. The apparatus 10 is shown in a raised and upright state of adjustment. The raising action is transmitted from the lower platform 21 thereonto the upper platform 22 by the motion of the two (2) pairs of crossed links 23*a*, 23*b*, 24*a* and 24*b* in a manner which is similar to the action of a state-of-the-art scissor table.

Figures 3A, 3B:
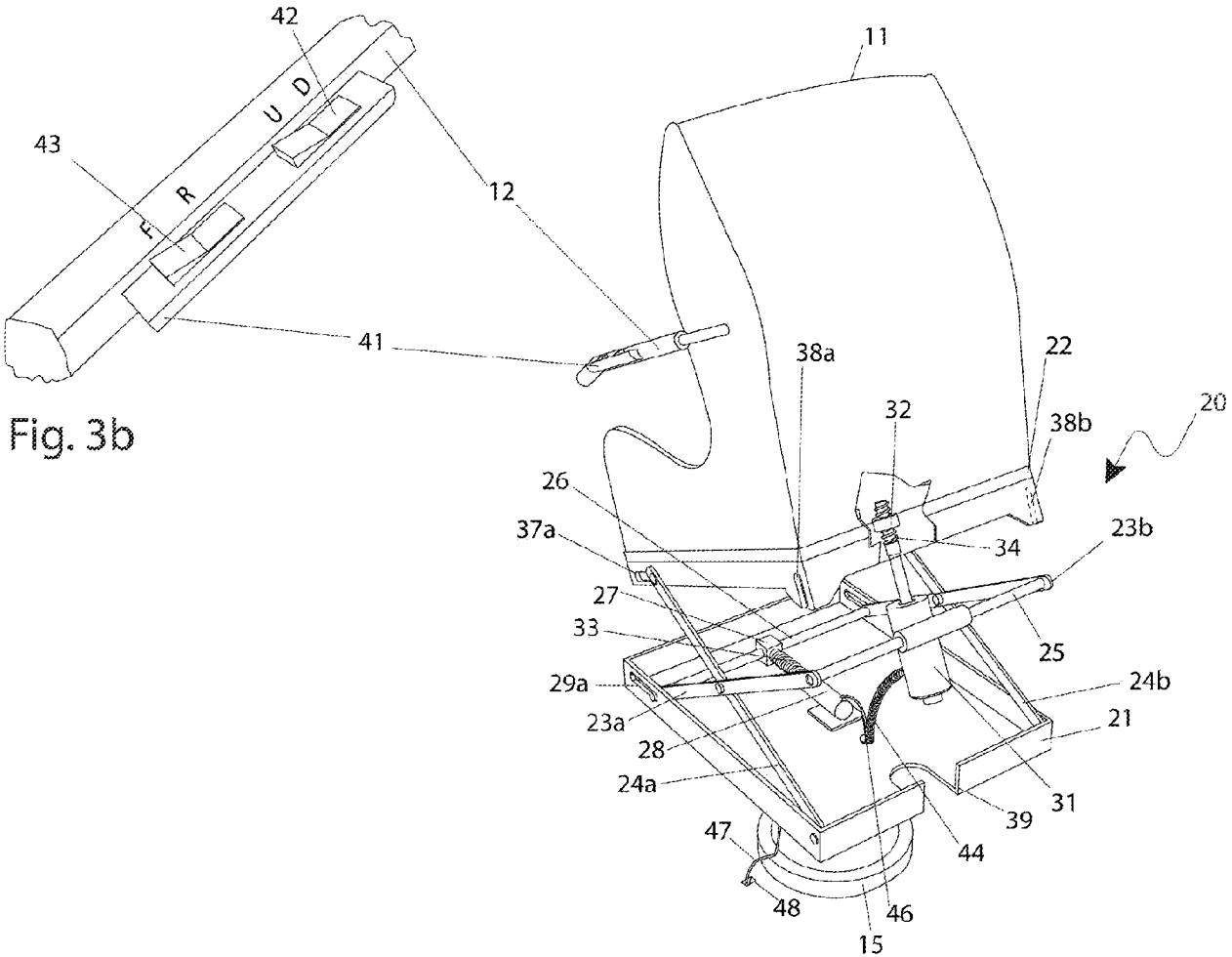
FIG. 3A is a perspective rear view of a mechanism 20 in a raised and tilted state, according to the preferred embodiment of the present invention.
FIG. 3B is a perspective top view of a control pad 41, according to the preferred embodiment of the present invention; and, FIG. 3C is a perspective rear view of a mechanism 20 in a raised and tilted state opposite of FIG. 3A, according to the preferred embodiment of the present invention.
Figure 3C:
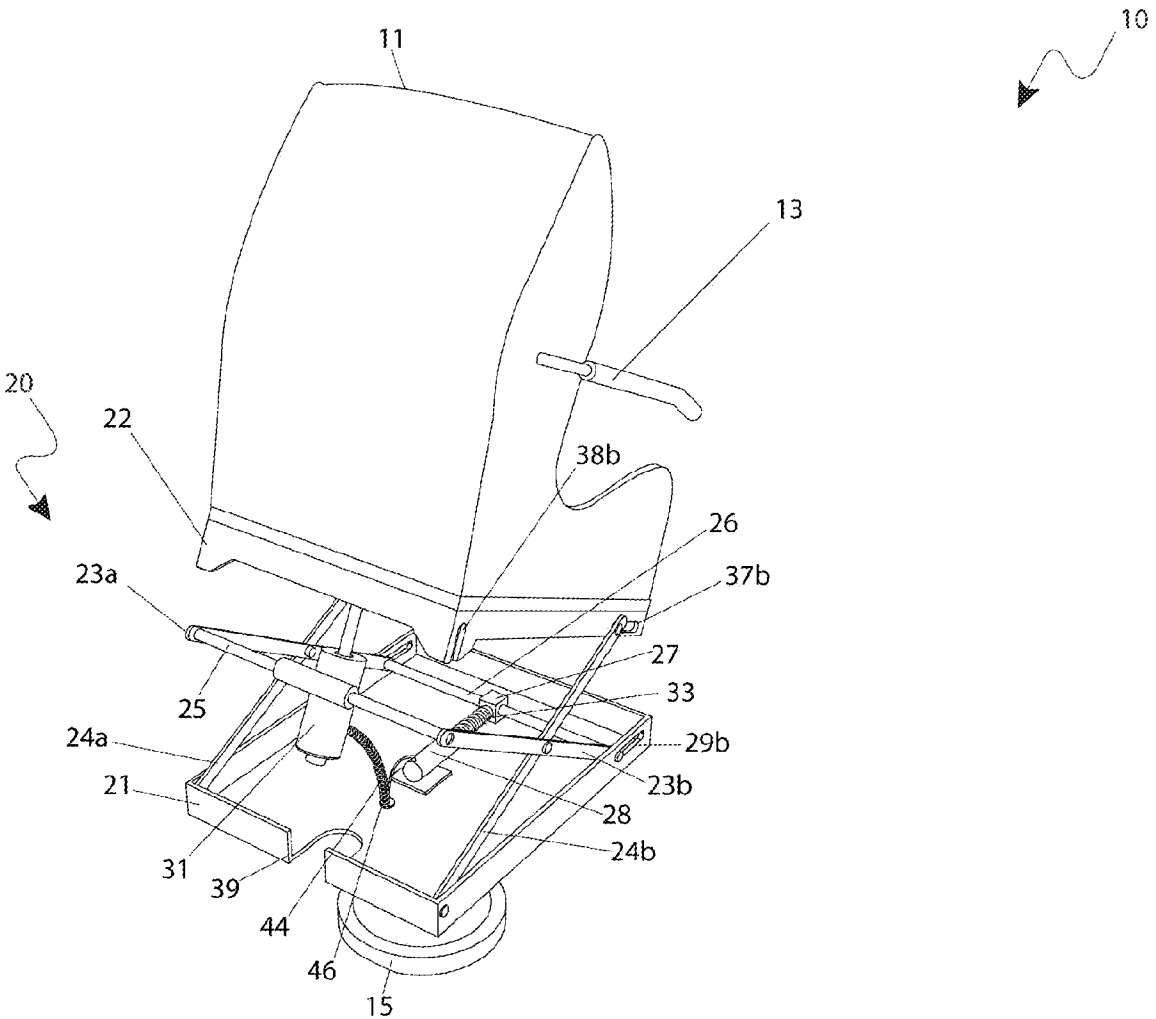

Referring now to FIG. 3A and FIG. 3C various perspective rear views of the adjusting mechanism 20 of the apparatus 10, according to the preferred embodiment of the present invention, are disclosed. The adjusting mechanism 20, depicted in a raised and forward-tilted position, comprises the lower platform 21 and the upper platform 22, a first link 23*a*, a second link 24*a*, a third link 23*b* and a fourth link 24*b*. A lower end of the first link 23*a* is pivotally connected thereonto a rearward end portion of a first side portion of the lower platform 21 while the opposite upper end of the first link 23*a* is slidingly connected thereonto a forward end portion of a first side portion of the upper platform 22 by means of a third slot 37*a*. A lower end of the second link 24*a* is pivotally connected thereonto an outer end of a second axle 26 while the opposite upper end of the second link 24*a* is pivotally connected to an outer end of a first axle 25. Furthermore, the center of the first link 23*a* is pivotally connected thereonto the center of the second link 24*a*, and each outer end of the second axle 26 is slidingly guided by means of a first slot 29*a* and a second slot 29*b* provided therewithin the frontward side end portions of the lower platform 22. In like manner, a corresponding third link 23*b* and fourth link 24*b* are assembled thereonto a second side of the platforms 21 and 22 and the corresponding opposite ends of the axles 25 and 26, wherein the opposite upper end of the third link 23*b* is slidingly connected thereonto a forward end portion of a second side portion of the upper platform 22 by means of a fourth slot 37*b*. The resulting X-like disposition of the first link 23*a*, the second link 24*a*, the third link 23*b* and the fourth link 24*b* is designed to allow the upper platform 22 to be raised upwardly away from the lower platform 21 in a symmetrically uniform action, while maintaining the stability of the apparatus 10. A jack window 39 located at a central rear location of the lower platform 21 is designed to provide a clear space to accommodate the second jack 31 when the chair 11 is in a lowered state. The adjusting mechanism 20 further comprises an electrically powered first jack 28, wherein an electric motor imparts a clockwise or counter-clockwise rotation thereonto a first screw 33, thereby imparting a forward or rearward motion thereonto a first nut 27. The first nut 27 is designed to transfer a forward or rearward motion thereonto the second axle 26, which, in turn, induces a scissor-like lifting action thereonto the crossed links 23*a* and 24*a* and 23*b* and 24*b*, thereby lifting the upper platform 22 and the chair 11 attached thereonto. A second jack 31, envisioned to function in a manner which is similar to the first jack 28, imparts a clockwise or counter-clockwise rotation thereupon a second screw 34. The second nut is designed to transfer an upward or downward motion thereonto a second nut 32, thereby raising or lowering the rear portion of the upper platform 22, thus tilting the chair 11 forwardly or returning it to a normally upright position. A first guide 38*a* provided therewithin the rear portion of the first side of the upper platform 22, and a second guide 38*b* provided therewithin the rear portion of the second side of the upper platform 22 are designed to ensure the scissor-like lifting action of the links 23*a*, 23*b*, 24*a* and 24*b* when the guides 38*a* and 38*b* are resting thereonto the ends of the first axle 25, while proving the rear portion of the upper platform 22 the freedom to be lifted thereinto the forwardly tilted position. A first cord 44 supplies electric power to the second jack 31, while a second cord 46 supplies electric power to the first jack 28, whereby both cords 44 and 46 are contained therewithin the pedestal 14 and terminate therewithin a receptacle 45, thus providing a means of connecting the apparatus 10 thereto the battery of the boat by means a power cord 47 whereby a first end comprises a male plug 49 connected thereto the female receptacle 45. The power cord 47 is routed therethrough an access aperture 48 thus allowing the second end of the power cord 47 to be connected to the battery of the boat by means of appropriate terminals.

Referring now to FIG. 3B, a partial perspective top view of the first arm 12 containing the control pad 41 of the apparatus 10, according to the preferred embodiment of the present invention, is disclosed. The control pad 41 comprises a first switch 42 and a second switch 43. The first switch 42 controls the upward and downward motion of the chair 11, wherein the appropriate commands are clearly designated as "U" for up and "D" for down in close proximity to the switch 42. Likewise, the second switch 43 controls the tilting of the chair and its functions are clearly marked as "F" for forward tilt and "R" for returning the chair to the normally upright position.

Alternative embodiments of the present invention 10 can comprise alternate electrically driven chair positioning mechanisms, such as, but not limited to: rack-and-pinion, worm-and-pinion, or hydraulic jacks. Furthermore, alternate embodiments could comprise options such as, but not limited to: a seat belt, a safety harness, or a restraining locking bar.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: receiving, unpacking and inspecting the apparatus 10 components; transferring the apparatus 10 components thereonto the boat deck 60; choosing a suitable deck 60 location; preparing the deck 60 location as needed; installing and securing the foot 15 and the pedestal 14 thereonto the deck 60; affixing the lower platform 21 thereto the chair mount 16; affixing the chair 11 thereonto the upper platform 22; connecting the first end of the power cord 47 thereonto the receptacle 45; routing the power cord 47 therethrough the access aperture; connecting the second end of the power cord 47 thereonto the boat battery; testing the raising and lowering function of the chair 11 by moving the first switch 42 alternately between the "U" and "D" positions; testing the tilting function by moving the second switch 43 alternately between the "F" and "R" positions; performing any necessary adjustments; and repeating the testing until a smooth and consistent operation is ensured.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An adjustable boat seat comprising:

a chair;

an adjusting mechanism connected to said chair in such a manner that said chair is adjustably positioned between forwardly tilted and normally upright positions respectively;

a chair mount securely fastened to said adjusting mechanism;

a pedestal connected to said chair mount;

a foot connected to said pedestal and adapted to be fastened to an upper portion of a boat deck; and, a first and a second axle;

wherein said adjusting mechanism further comprises:

a control pad connected to said chair and having a plurality of motion control switches for adjusting a position of said chair;

a lower platform affixed to said chair mount;

an upper platform connected to said chair and said lower platform;

a first pair of crossed links connecting a first side portion of said lower platform to a corresponding side portion of said upper platform; and, a second pair of crossed links connecting a second side portion of said lower platform to a corresponding side portion of said upper platform; and, wherein a lower end of said second pair of crossed links is pivotally connected onto an outer end of said second axle while an opposite upper end of said second pair of crossed links is pivotally connected to an outer end of said first axle.

2. The adjustable boat seat of claim 1, wherein a lower end of said first pair of crossed links is pivotally connected onto a rearward end portion of said first side portion of said lower platform while an opposite upper end of said first pair of crossed links is slidingly connected onto a forward end portion of a first side portion of said upper platform.

3. The adjustable boat seat of claim 2, wherein said adjusting mechanism further comprises:

a first guide provided within said rear portion of said first side of said upper platform; and, a second guide provided within said rear portion of said second side of said upper platform;

wherein said first and second guides are engaged with said first axle.

4. The adjustable boat seat of claim 1, further comprising:

first and second slots provided at frontward side end portions of said lower platform;

wherein a center of said first pair of crossed links is pivotally connected to each other and a center of said second pair of crossed links is pivotally connected to each other; and, wherein each outer end of said second axle is slidingly guided by said first slot and said second slot.

5. The adjustable boat seat of claim 1, wherein said first pair of crossed links, said second pair of crossed links are oriented in an "X" disposition such that said upper platform is raised upwardly away from said lower platform in a symmetrically uniform action.

6. The adjustable boat seat of claim 5, wherein said adjusting mechanism further comprises:

an electrically powered rotatable first jack; and, a first screw and a first nut connected thereto;

wherein said first nut transfers forward and rearward motion onto said second axle and thereby causes a scissor-like lifting action onto said first and second pairs of crossed links so that said upper platform and said chair are lifted.

7. The adjustable boat seat of claim 6, wherein said adjusting mechanism further comprises:

a second jack; and, a second screw and a second nut rotatably attached thereto;

wherein a rear portion of said upper platform is raised and lowered when an upward and downward motion is transferred onto said second nut.

8. An adjustable boat seat comprising:

a chair having first and second arms connected thereto;

an adjusting mechanism connected to said chair in such a manner that said chair is adjustably positioned between forwardly tilted and normally upright positions respectively;

a chair mount securely fastened to said adjusting mechanism;

a pedestal connected to said chair mount;

a foot connected to said pedestal and adapted to be fastened to an upper portion of a boat deck; and, a first and a second axle;

wherein said adjusting mechanism comprises:

a control pad connected to said chair and having a plurality of motion control switches for adjusting a position of said chair;

a lower platform affixed to said chair mount;

an upper platform connected to said chair and said lower platform;

a first pair of crossed links connecting a first side portion of said lower platform to a corresponding side portion of said upper platform; and, a second pair of crossed links connecting a second side portion of said lower platform to a corresponding side portion of said upper platform; and, wherein a lower end of said second pair of crossed links is pivotally connected onto an outer end of said second axle while an opposite upper end of said second pair of crossed links is pivotally connected to an outer end of said first axle.

9. The adjustable boat seat of claim 8, wherein a lower end of said first pair of crossed links is pivotally connected onto a rearward end portion of said first side portion of said lower platform while an opposite upper end of said first pair of crossed links is slidingly connected onto a forward end portion of a first side portion of said upper platform.

10. The adjustable boat seat of claim 9, wherein said adjusting mechanism further comprises:

a first guide provided within said rear portion of said first side of said upper platform; and, a second guide provided within said rear portion of said second side of said upper platform;

wherein said first and second guides are engaged with said first axle.

11. The adjustable boat seat of claim 8, further comprising:

first and second slots provided at frontward side end portions of said lower platform;

wherein a center of said first pair of crossed links is pivotally connected to each other and a center of said second pair of crossed links is pivotally connected to each other; and, wherein each outer end of said second axle is slidingly guided by said first slot and said second slot.

12. The adjustable boat seat of claim 8, wherein said first pair of crossed links, said second pair of crossed links are oriented in an "X" disposition such that said upper platform is raised upwardly away from said lower platform in a symmetrically uniform action.

13. The adjustable boat seat of claim 12, wherein said adjusting mechanism further comprises:

an electrically powered rotatable first jack; and, a first screw and a first nut connected thereto;

wherein said first nut transfers forward and rearward motion onto said second axle and thereby causes a scissor-like lifting action onto said first and second pairs of crossed links so that said upper platform and said chair are lifted.

14. The adjustable boat seat of claim 13, wherein said adjusting mechanism further comprises:

a second jack; and, a second screw and a second nut rotatably attached thereto;

wherein a rear portion of said upper platform is raised and lowered when an upward and downward motion is transferred onto said second nut.

* * * * *